United States Patent [19]

Ludwig

[11] Patent Number: 4,565,325

[45] Date of Patent: Jan. 21, 1986

[54] WATER COOLING APPARATUS FOR METAL SHEETS AND BELTS

[75] Inventor: Bernhard Ludwig, Ratingen, Fed. Rep. of Germany

[73] Assignee: Mannesmann Aktiengesellschaft, Dusseldorf, Fed. Rep. of Germany

[21] Appl. No.: 738,897

[22] Filed: May 29, 1985

Related U.S. Application Data

[63] Continuation of Ser. No. 486,368, Apr. 19, 1983, abandoned.

[30] Foreign Application Priority Data

Apr. 23, 1982 [DE] Fed. Rep. of Germany ..... 3215248

[51] Int. Cl.[4] ..... B05B 1/04

[52] U.S. Cl. ..... 239/597; 239/193

[58] Field of Search ..... 239/590.3, 590.5, 590, 239/597, 598, 601, 193

[56] References Cited

U.S. PATENT DOCUMENTS 3,341,354 9/1967 Woods et al. ..... 239/597 X
3,375,981 4/1968 Keck ..... 239/597 X
3,841,566 10/1974 Wilford ..... 239/597 X
3,938,468 2/1976 Kirschner ..... 239/597 X
4,210,288 7/1980 Dobson ..... 239/597

FOREIGN PATENT DOCUMENTS 2235063 1/1973 Fed. Rep. of Germany .
2804982 8/1978 Fed. Rep. of Germany .

*Primary Examiner*—Jeffrey V. Nase
*Assistant Examiner*—Daniel R. Edelbrock
*Attorney, Agent, or Firm*—Mandeville and Schweitzer

[57] ABSTRACT

A water cooling box for providing laminar cooling water to metal sheets. A slit nozzle, extending across the width of the sheets to be cooled is provided with a means for effecting a water pressure drop. The slit nozzle, in one embodiment, has parallel walls and is provided with a cylindrical rod spaced slightly above the nozzle entrance. In another embodiment, the walls of the slit nozzle progressively diverge from the entrance to the nozzle exit. In yet a third embodiment, the slit nozzle, at the entrance, has a length of parallel walls and then, at a point below the entrance, has progressively diverging walls. The structural details of the water box are also described.

7 Claims, 7 Drawing Figures

WATER COOLING APPARATUS FOR METAL SHEETS AND BELTS

RELATED APPLICATIONS

This application is a continuation application of Application Ser. No. 486,368, filed Apr. 19, 1983, now abandoned.

BACKGROUND OF THE INVENTION AND DESCRIPTION OF THE PRIOR ART

The present invention relates to an apparatus for producing a compact and efficient water cooling curtain for cooling moving metal sheets and belts. One or several water boxes are distributed along the entire length of a cooling track, each of these boxes are connected with water supply sources and each are provided with a narrow inlet or slit nozzle which is arranged across the direction of motion of the sheets or belts to be cooled. The cooling water is directed between the longitudinal walls of the slit nozzle and the water continuously exits therefrom so that a maximum laminar current of water flow is achieved.

The cooling requirements which relate to the output of water necessitates that the current flow, within the water curtain, be as laminar as possible, thereby contributing to stability, homogenity, and improvement of the desired cooling effect. To this end, it is known to provide one or several rectangular slit nozzles across the entire width of the goods to be cooled. The longitudinal walls of these nozzles are pivotal, thereby allowing a gradual adaptation of the cooling water current to individual operational conditions. The adjustment, in this manner, occurs such that the longitudinal walls are paired and are highly convergent with respect to each other. The exit openings of those slit nozzles for the cooling water are relatively narrow as compared to the entrance openings. Non-adjustable longitudinal walls have been provided with a circular or concave profile, in order to narrow the exit opening. In order to support the effect in the known water-cooling apparatus it is furthermore provided for wedge-shaped sliders of a convex-concave profile to mesh into the nozzle slit. See, for example, German reference DE-PS No. 22 35 063.

Furthermore, it is also known, for the providing of a compact and continuous water curtain for cooling to have the water strike the goods from a great height (see German reference DE-OS No. 28 04 982). In addition, it is known to insert, in a rectangular slit nozzle, the entrance opening of which has a considerably larger cross sectional area than the exit opening, additional sieve-type components having a plurality of adjacent converging conduits in the nozzle, so as to further reinforce the convergence effect.

The above concepts of converging slit nozzles for decreasing turbulence at the nozzle exit can be, to some extent, quite costly to install and can, in practice, only be realized at great relative expense.

SUMMARY OF THE INVENTION

The present invention starts from the premise that the cooling water should be applied by passing it through rectangular slit nozzles and thereby causing the water to drop freely onto the goods to be cooled. The water curtain, rectangular in cross section, is as wide as the side width of the goods to be cooled, i.e., the nozzle extends fully across the width of the cooling metal sheets. However, the narrow side of the slit nozzle is dimensionally dependent on the desired cooling task, i.e., whether the cooling effectivity or the cooling intensity should prevail. In any event, however, the narrow side of the rectangular slit nozzle must be as large as possible at the nozzle exit in order to achieve an effective cooling width as large as possible, subsequent to the normally present contraction of the cooling width due to the law of fluid continuity and the height of the water fall. This is so because, with the cooling action being accomplished by a water falling curtain, the calculation of the cooling effect not only is dependent on the outflowing quantity of cooling water per unit time, but also on the effective cooling width. From this realization, as to the requirement regarding the water output, the water curtain is to be as wide as possible with the least possible outflowing per unit time in the area of application, thereby optimizing the moistening width.

An object of the present invention, therefore, is to provide a water-cooling apparaus having a coherent water curtain and a large cooling or moistening width, with the water falling from a great falling height and with the elimination of adjustable or rotatable wall elements of the rectangular slit nozzles or their profiling or other components. The solution is achieved, according to the present invention, in effecting, at least in the area of the nozzle inlet or a part of the water fall height, a drop in pressure, by enlarging the cross section, thereby achieving a decrease in the speed of the water outflow. In addition, the nozzle inlet is less than or equal to the area of the nozzle outlet.

The inventive concept of utilizing divergence from the conventionally used converging nozzle walls, rests on the following line of thought: In the predetermined slit-nozzle width, the flow or exit speed of the cooling water is of critical significance for the water output, in which the quantity of the exiting water per unit time could be regulated. Tests have shown that, presuming a constant slit width, strong turbulences occur at great speeds, however, at low speeds the water curtain is not stable and the water contraction too great, i.e., the cooling or moistening width becomes narrow. It has now been found that a suitably low exit speed with at least quasi laminar exit flow allowing, in any case, for a coherent water curtain, can be obtained if part of the necessarily present minimum pressure measured from the nozzle inlet to the nozzle outlet—is eliminated by speed control of the water at the water inlet, i.e., as a loss in pressure. It is appropriate to adjust for such a loss in pressure, resulting in an exit speed of 1.4 m/s, thereby rendering possible a significantly improved water curtain without the risk of water discontinuity.

The drop in pressure in the sense of the invention may be achieved in different ways. One possibility is that the longitudinal walls of the nozzle extend parallel to each other with a narrowing throttling point provided above the nozzle inlet, for example, a round rod, constricting the water supply to the inlet. Alternatively, the longitudinal nozzle walls of the slit nozzle can extend divergingly, enlarging the outlet as compared to the inlet, in which the traverse walls of the nozzle may also diverge. An additional drop in pressure results, if the longitudinal walls of the nozzles are designed with sharp edges in the area of the nozzle inlet. All these simple measures replace the previous expenditure for additional apparatus such as, for example, the rotatability of the longitudinal walls of the nozzles in order to obtain a coherent water curtain with a large cooling or moistening width.

The present invention, in addition, steadies the water supply in front of the nozzle inlet, since better laminar flow is possible when the entering water is steady. This, too, is precondition for the creation of a coherent water curtain.

The invention is detailed below with the exemplary embodiments illustrated in the drawings.

DETAILED DESCRIPTION OF THE INVENTION

Figure 1:
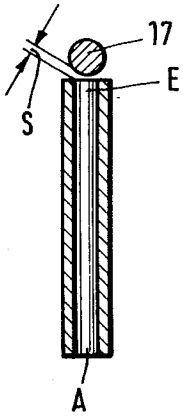
FIG. 1 is a cross sectional view of a simplified version of a rectangular slit nozzle having parallel longitudinal walls.
Figure 2:
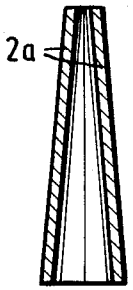
FIG. 2 is a cross sectional view of a slit nozzle having diverging longitudinal walls.
Figure 3:
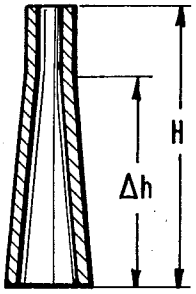
FIG. 3 is a cross sectional view of a slit nozzle having partly parallel longitudinal walls, and in the lower portion, having diverging longitudinal walls.

The slit nozzle shown in FIG. 1 has parallel longitudinal side walls. Arranged above the nozzle inlet is a horizontally extending round rod 17 located at a distance from the inlet such that two contraction gaps S result, one on each side of rod 17. A drop in pressure thus results as water flows through the nozzle contraction gaps S (which are enlarged in the drawings for a clearer understanding of the invention). The same pressure drop effect can be achieved by the longitudinal walls 2*a*, shown in FIG. 2. These walls diverge along the entire nozzle height. As shown in FIG. 3, a pressure drop effect can also be achieved if the longitudinal wall is parallel for a portion of its height and then diverges for a distance Δh of the total height H. If, for example, the total water fall height H (see FIG. 3) is presumed, for fluid dynamics reasons, as being 0.45 m, and an exit speed $V_o$ of 1.4 m/s is desired, the necessary pressure drop loss will be achieved by having Δh, the height of the diverging extension of the longitudinal walls, calculated as follows:

$$V_o = \sqrt{2\,g\,(H - \Delta h)}$$

$$\Delta h = H - \frac{V_o^2}{2\,g}\text{; for } g = 9.8\ \text{m/s}^2,\ H = 0.45\ \text{m and } V_o = 1.4\ \text{m/s}$$

$$\Delta h = 0.45 - \frac{1.4^2}{2\,g} = 0.35\ \text{m}$$

Figure 4:
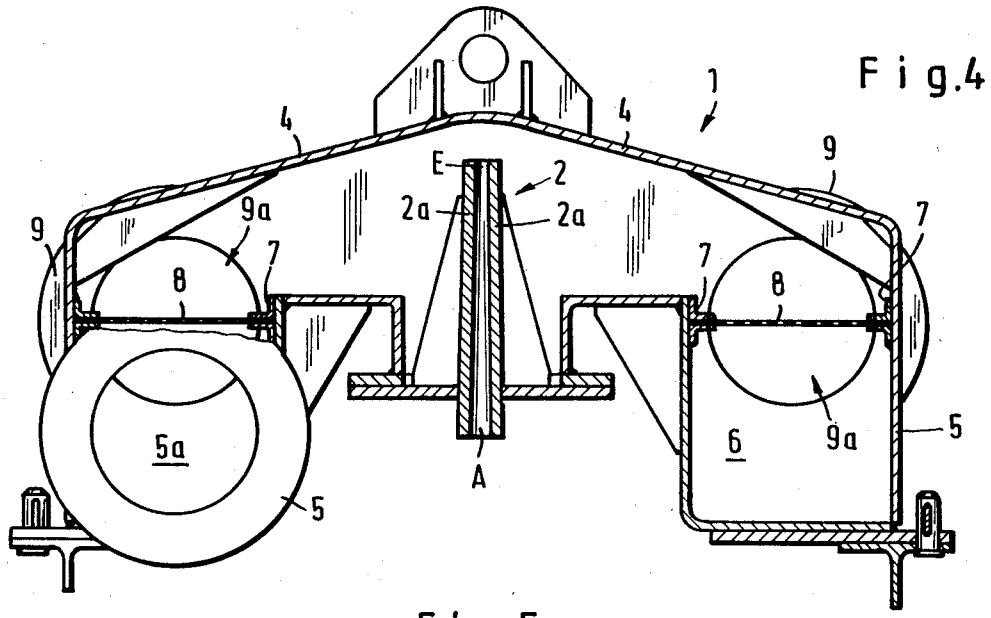
FIG. 4 is a partial cross sectional view of a first and the preferred exemplary embodiment of a water box having a rectangular slit nozzle similar to the one shown in FIG. 2.

The water box, characterized in its entirety as 1 in FIG. 4, has a rectangular slit-shaped nozzle 2 located at its center. This arrangement ensures that the water runs evenly into the nozzle inlet E from all sides of the water box. The slit nozzle 2 comprises two longitudinal walls 2*a* extending across the entire width of the goods, i.e., metal sheets or belts to be cooled (which goods are not illustrated). The side walls 2*a* are designed with sharp edges in the area of the nozzle inlet E. The longitudinal walls 2*a* are easy to exchange for other longitudinal walls and/or may be adjustable to allow the degree of divergence between the walls to be selected. The distance between the walls is set such that the inlet E is narrower than the outlet A. The end walls of the nozzle, not illustrated, may also be designed so as to be downwardly diverging, with the intended effect that the length of the side of the water curtain, as it strikes the goods to be cooled, is approximately equal to the length of the side of the slit nozzle at the outlet A.

The water box 1 has roof wall units 4 which slope laterally downward along both sides of the slit nozzle, commencing at the area above the nozzle inlet E and extending traversely to the longitudinal extension of the slit nozzle. Only a relatively minimal clearance exists between roof wall unit 4 and the nozzle inlet E. The small clearance between roof wall units 4 and nozzle inlet E allows for the nozzle to be quickly filled up or emptied, thereby insuring short lead times and trailing times. A water supply chamber 6 is connected at both sides to the water box 1 from which chamber the water enters into the water box. The water flows from chamber 6 by rising through horizontally arranged perforated metal sheet 8 which serve as additional speed or current controls. The water flows into the supply chamber 6 by passing through water feeders 5. According to FIG. 5, the water flows into the chambers 6 from only one side of the water box. The feeding of water into the supply chambers 6 can, of course, also advantageously occur from the two opposite sides of the water box. As supply chambers 6 increasingly fill up, the water level rise and reaches the perforated metal sheets 8, inserted between the flanges 7 of the water box, and continues to rise, up to the water box 1 proper, filling it up. The perforated metal sheets are easily accessible for cleaning by releasing blind flanges 9. In FIG. 4 it can be seen that the through bore 9*a*, closed off by the blind flange 9, is arranged for access to the perforated metal sheets 8 which are located at each feeder 5 above the through opening 5*a*.

Figure 5:
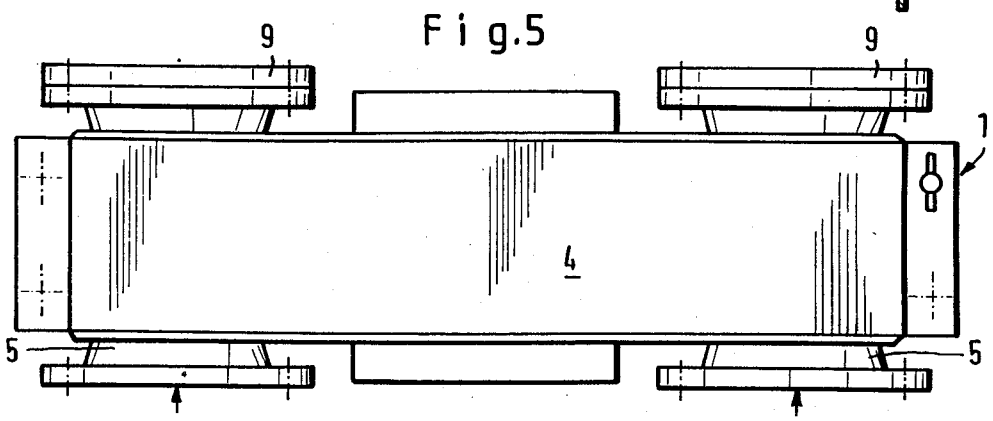
FIG. 5 is a top plan view of the water box of FIG. 4.

The design of the water box, together with the water supply design, shown in FIGS. 4 and 5 provides a steadying influence to the flow of water, beginning first with the water feed-in, in which the perforated metal sheets eliminate to a great extent the otherwise present horizontal water current components caused by the horizontally directed water feed. This, then, eliminates to a large degree the horizontal current interference from occurring at the nozzle inlet. The relative long distance between the speed and current controlling perforated metal sheets 8 and the nozzle inlet E further facilitates a steadying influence on the water current flow.

Figure 6:
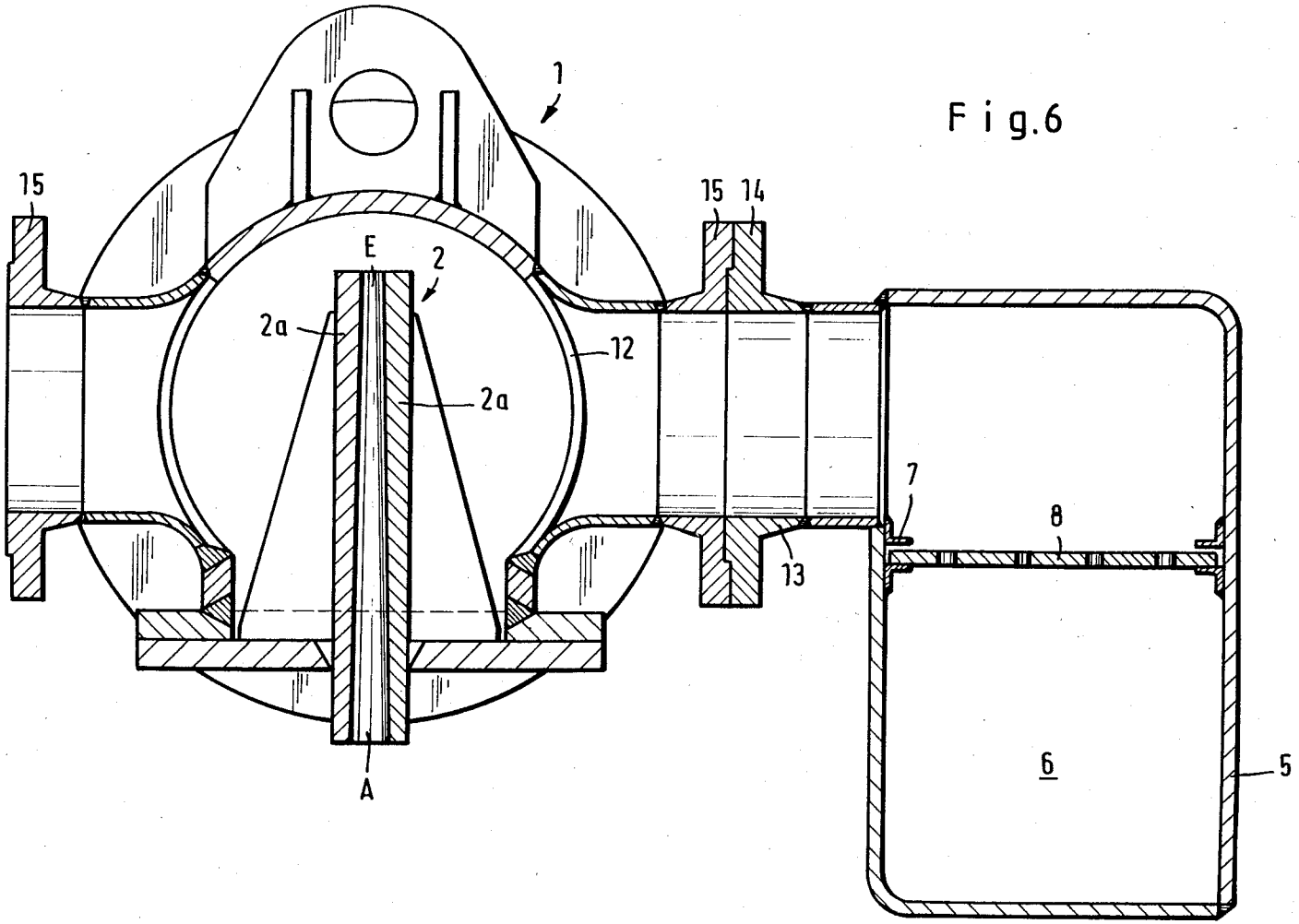
FIG. 6 is an enlarged partial cross sectional view of a second exemplary embodiment of the water box and the diverging type nozzle of FIG. 2.
Figure 7:
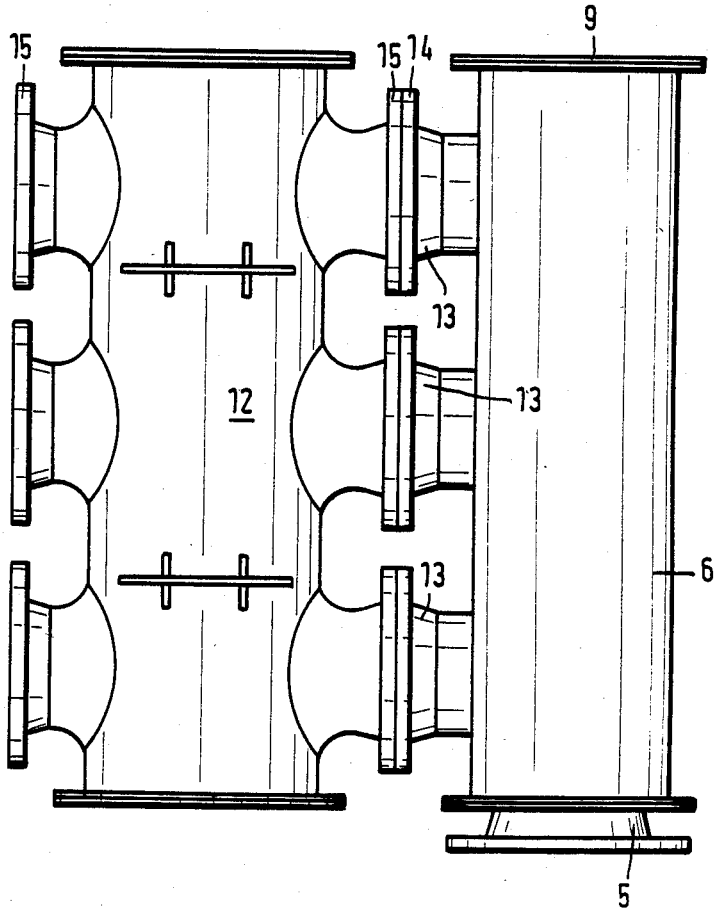
FIG. 7 is a top plan view of the embodiment shown in FIG. 6.

In the exemplary embodiment of the invention shown in FIGS. 6 and 7, the water box 1 is designed as a pipe, i.e., it presents a somewhat cylindrically shaped collecting container 12. Here, too, laterally sloping roof wall units are provided by which the flow of water above the inlet E of the slit nozzle 2 is minimized. The water enters the box through water feeder 5 (see FIG. 7) and passes into a laterally located water storage chamber 6 in which a perforated metal sheet 8 is arranged, from side wall to side wall, between flanges 7 (see FIG. 6). The water, in this embodiment, does not directly enter into the nozzle 2, in contrast to the exemplary embodiment of FIGS. 4 and 5 but, rather, first flows into the water collecting container 12 as the space above the perforated metal sheet 8 fills. The water first passes through horizontal connections 13, which are distributed along the length of the pipe-shaped water collecting container 12 and open into the water supply chamber 6 above the perforated metal sheet 8. The water supply chamber 6 is connected to container 12 by horizontal connections 13 which are secured by flanges 14 and 15. The partitioning of the water supply to the water collecting container 12, by passing it through several horizontal connections 13 has a further water current steadying effect on the water flow. It is recommended to provide three connections 13 per meter length of the water box in order to eliminate the longitudinal current in the feeder 5, arranged below the metal sheet, and directed parallel to the slit nozzle 2. If the goods to be cooled are very wide at the water supply chamber 6, arranged at both sides of the water collecting container 12, it is recommended to have connections 13 of sufficient length to accommodate the width of the material to be cooled. For this reason, the water box is provided with cylindrical connecting flanges 15 so that additional lengths of pipe can be installed between flanges 14 and 15 to accommodate the water cooling of widths of wide sheets.

The cooling mechanism, according to the invention, can be used in any situation where moving flat material is intended to be cooled, for example, in front of and between the finishing stands of a hot-belt conveyor, after finishing stands, as well as for cooling metal sheets at the various points in the production area of a metal-sheet rolling mill, to thereby achieve a desired metal structure by a heat treatment. For optimal exploitation of the water, it is, therefore, appropriate to arrange for different water outflow and also different slit widths of the nozzles. This renders it possible to obtain, for example in a heat-belt track, the desired jumps in temperature per water box which makes for a finely controlled cooling zone as required in modern discharge roller-bearing cooling installations.

As to the surface ratio between nozzle inlet E and nozzle outlet A, a ratio value of 1:2 is recommended. A slit width at the inlet E of 10–12 mm is also recommended.

It should be understood, of course, that the specific form of the invention herein illustrated and described is intended to be representative only, as certain changes may be made therein without departing from the clear teachings of the disclosure.

I claim:

1. An apparatus for providing a coherent gravity fed water curtain to cool metal sheets moving in a substantially horizontal direction, comprising:

(a) a water holding box;

(b) said water holding box being provided with an inlet for attachment to a constant source of water;

(c) said water holding box being provided with a vertically extending slit-shaped nozzle extending across said substantially horizontal direction;

(d) said slit-shaped nozzle having a pair of longitudinal water containment walls extending both basically vertically in said water holding box and across said substantially horizontal direction, said slit-shaped nozzle also having a pair of side water containment walls, said slit-shaped nozzle ending with a top-located nozzle inlet and a bottom-located nozzle outlet; and (e) said slit-shaped nozzle being provided with a net overall water pressure drop means between said nozzle inlet and said nozzle outlet such that the water pressure entering said nozzle inlet is greater, along said longitudinal water containment walls, than said water pressure leaving said nozzle outlet.

2. An apparatus as claimed in claim 1, wherein:

(a) said net overall water pressure drop means comprises a longitudinally extending bar suspended immediately above and substantially along said longitudinal water containment walls yet not in contact with said nozzle inlet.

3. An apparatus as claimed in claim 1, wherein:

(a) said net overall water pressure drop means is provided by said longitudinal water containment walls diverging downwardly so that the cross sectional area of fluid flow of said nozzle inlet is less than the same of said nozzle outlet.

4. An apparatus as claimed in claim 3, wherein:

(a) said longitudinal water containment walls have a portion which extends vertically and parallel to one another for a distance starting proximal to said nozzle inlet and ending at a location above said nozzle outlet whereupon said longitudinal water containment walls extend vertically yet diverging from one another until a location proximal said nozzle outlet.

5. An apparatus as claimed in claim 4, wherein:

(a) said location where said longitudinal water containment walls begin to diverge above said nozzle outlet, $\Delta h$, is calculated as:

$$\Delta h = \frac{H - V_O^2}{2g}$$

wherein:

H = the full height of said longitudinal water containment walls;

$V_o$ = the predetermined desired speed of water flow through said nozzle outlet; and g = the gravitational acceleration constant.

6. An apparatus as claimed in claim 3, wherein:

(a) the dimensional ratio of the width of said nozzle inlet to said nozzle outlet is in the range of about 1:2.

7. An apparatus as claimed in claim 1, further comprising:

(a) said water holding box is provided with a central peaked roof comprised of downwardly diverging sloping roof elements;

(b) the peak of said roof being located above said nozzle inlet; and (c) the distance between said nozzle inlet and said peak of said roof is relatively small compared to the height of said longitudinal water containment walls.

* * * * *